United States Patent [19]

Hammond et al.

[11] 4,009,029

[45] Feb. 22, 1977

[54] CYANOETHYL-CONTAINING BLOCKED DEVELOPMENT RESTRAINERS

[75] Inventors: Howell Allen Hammond; Wilbert Jeptha Humphlett; Ilmari Fritiof Salminen, all of Rochester, N.Y.

[73] Assignee: Eastman Kodak Company, Rochester, N.Y.

[22] Filed: June 20, 1975

[21] Appl. No.: 588,976

Related U.S. Application Data

[63] Continuation-in-part of Ser. No. 367,306, June 5, 1973, abandoned.

[52] U.S. Cl. ..... 96/3; 96/29 D; 96/66.3; 96/73; 96/74; 96/76 R; 96/77; 96/95; 96/99; 96/100; 96/109

[51] Int. Cl.[2] ..... G03C 7/00; G03C 5/30; G03C 1/48; G03C 1/40

[58] Field of Search ..... 96/95, 76 R, 77, 3, 96/29 D, 66.3, 109, 73, 74, 99, 100

[56] References Cited

UNITED STATES PATENTS

| | | | |
|---|---|---|---|
| 2,819,965 | 1/1958 | Murray et al. | 96/109 |
| 2,981,624 | 4/1961 | Dersch et al. | 96/109 |
| 3,260,597 | 7/1966 | Weyerts et al. | 96/3 |
| 3,265,498 | 8/1966 | Rogers et al. | 96/3 |
| 3,420,664 | 1/1969 | Dersch et al. | 96/66.5 |
| 3,632,345 | 1/1972 | Marx et al. | 96/95 |
| 3,674,478 | 7/1972 | Grasshoff et al. | 96/3 |
| 3,698,897 | 10/1972 | Gompf et al. | 96/3 |
| 3,756,821 | 9/1973 | Hayashi et al. | 96/55 |
| 3,785,813 | 1/1974 | Rickter | 96/3 |
| 3,839,041 | 10/1974 | Hiller | 96/109 |
| 3,893,859 | 7/1975 | Burness et al. | 96/109 |

FOREIGN PATENTS OR APPLICATIONS 768,071 7/1971 Belgium

OTHER PUBLICATIONS

Allen and Humphlett, "The Thermal Reversibility of . . . Reaction. V", Canadian J. of Chem. vol. 44, 1966, pp. 2315–2321.

*Primary Examiner*—David Klein
*Assistant Examiner*—Richard L. Schilling
*Attorney, Agent, or Firm*—G. E. Battist

[57] ABSTRACT

Photographic elements are disclosed which contain a blocked development restrainer which is designed to provide timely release of a development restrainer when the photographic element is processed with an alkaline processing composition. The photographic elements are especially useful in image-transfer film units where the blocked development restrainers will permit initial development to occur and, upon cleavage, will substantially restrain further development.

33 Claims, 2 Drawing Figures

CYANOETHYL-CONTAINING BLOCKED DEVELOPMENT RESTRAINERS

Figure 1:
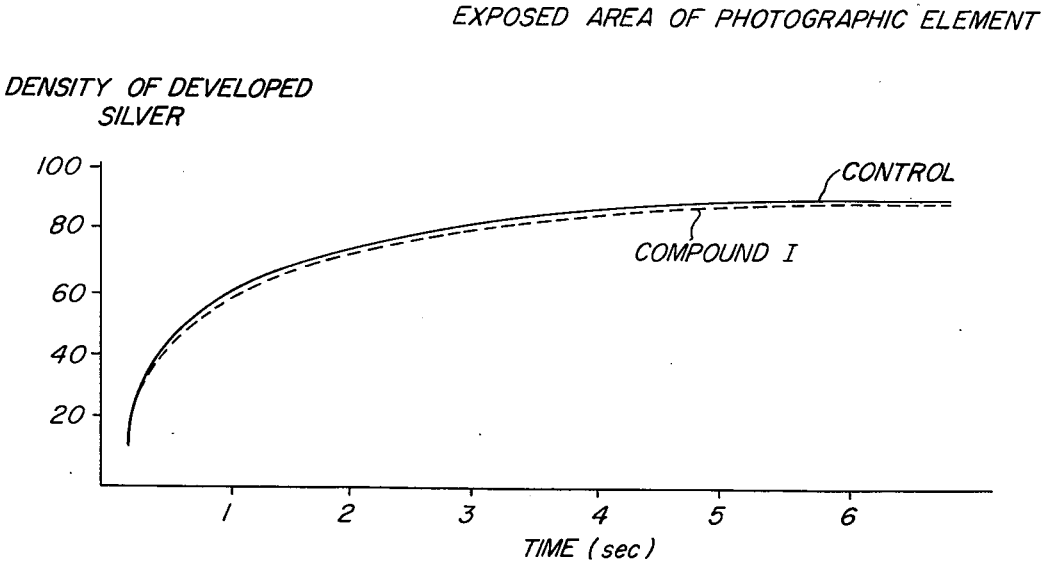

This application is a continuation-in-part of U.S. Ser. No. 367,306 filed June 5, 1973, now abandoned.

This invention relates to photographic elements and processes for developing image records in photographic elements. In one aspect, this invention relates to photographic elements which contain development-restrainer precursors. In another aspect, this invention relates to image-transfer photographic film units containing development-restraining precursors.

It is known in the art to use development arrestors and development-arrestor precursors in photograhic systems, as mentioned in U.S. Pat. Nos. 3,260,597 by Weyerts et al. and 3,265,498 by Rogers. In these references, the development arrestor was generally made available after a predetermined length of time by positioning it in a receiver layer and/or using a hydrolyzable derivative of the development arrestor whereby the action of the development arrestor would be delayed. However, the compounds available in the art did not generally have the necessary control properties whereby they could be incorporated in the photographic element and still permit the necessary development to take place before functioning in their role as development restrainers or development arrestors. In some instances, a low concentration of a compound which quickly hydrolyzed could be located in the photographic element to serve as an antifoggant where it would, in essence, restrain development of the Dmin and Dmax areas with a sacrifice in maximum density to control the density in the Dmin areas. Other attempts have also been made to provide compounds which have the proper release rate whereby they will become more active at higher temperatures, etc., as mentioned in U.S. Pat. Nos. 3,575,699; 3,649,267 and the like. However, it would be desirable to find improved compounds which have appropriate built-in control whereby they would permit substantial development of a silver halide image layer to occur before the compounds became activated to fulfill their development-restrainer function.

We have now found a class of blocked development restrainers (i.e., development-restrainer precursors) which can be used in photographic elements with improved results when processing the element in an alkaline medium. Generally, the class of blocked development restrainers which can be used in accordance with this invention is represented by the formula:

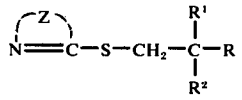

wherein Z represents the nonmetallic atoms (and bonds) necessary to form a nucleus which completes a 5- or 6-membered heterocyclic ring on said structure, including substituted rings, fused rings and the like, and wherein said heterocyclic ring, taken together with the depicted sulfur atom, provides a silver halide development restrainer upon cleavage from the remainder of the molecule; R is a cyano group; and $R^1$ and $R^2$ are preferably each hydrogen atoms, but can be alkyl groups having from 1 to 8 carbon atoms, including substituted alkyl groups, or aryl groups containing from 6 to 12 carbon atoms, including substituted aryl groups, provided that at least one of $R^1$ and $R^2$ is hydrogen.

The development restrainer moieties which are released upon cleavage can generally be any of the moieties within the formula limitations which are effective in arresting or restraining silver halide development. However, the structure of the remainder of the molecule is designed to provide for the timely release in the alkaline medium encountered in processing photographic elements, and particulaly where the alkaline medium has a pH of about 12 (i.e., 12–14). The blocked development restrainers having a cyano group appear to have superior aging properties in a photographic element compared with other blocked development restrainers.

The improvements obtained with the present class of compounds are quite unexpected since closely related compounds do not provide the same improvements. The present compounds have certain highly advantageous properties compared with the compounds mentioned in U.S. Pat. No. 3,260,597 and especially closely related 5-β-acetylethylthio-1-phenyl-1,2,3,4-tetrazole mentioned in column 5 of this reference. The compounds of the present invention provide especially good results when incorporated in the photographic element along with negative silver halide emulsions, whereas many of the compounds of U.S. Pat. No. 3,260,597 appear to react so readily as to require positioning of the compound in the receiver sheet to delay action of the development restrainer on the developing silver halide image record. While the compounds of this invention are preferably used in the photosensitive elements when negative silver halide emulsions are employed, they can also be used in cover sheets or receiver sheets, such as when direct-positive emulsions are employed in the element.

In one embodiment, this invention relates to image-transfer film units comprising:

1. a photosensitive element comprising a support having thereon at least one layer containing a silver halide emulsion having associated therewith an image dye-providing material and a blocked development restrainer of the above formula,
2. an image-receiving layer and
3. means containing an alkaline processing composition adapted to discharge its contents within said film unit.

In another embodiment, this invention relates to a photographic image-transfer film unit containing at least one layer containing a blue-sensitive silver halide emulsion, at least one layer containing a green-sensitive silver halide emulsion and at least one layer containing a red-sensitive silver halide emulsion, and at least one of said silver halide emulsions having associated therewith a blocked development restrainer of the above formula.

Figure 2:
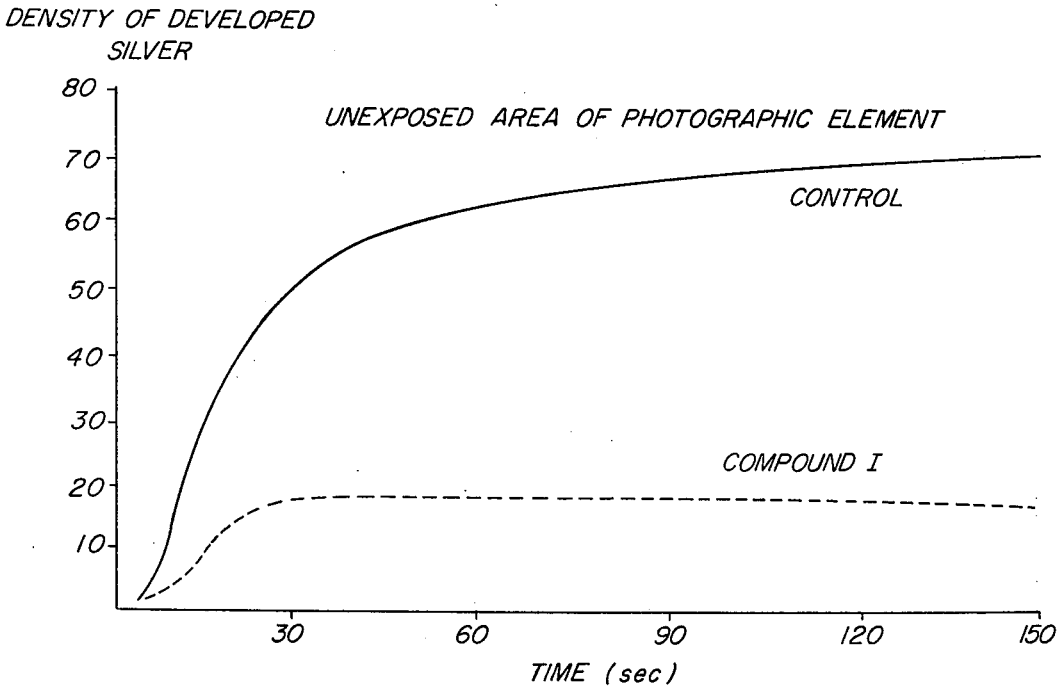

FIGS. 1 and 2 are graphs illustrating the amount of silver formed with respect to time in the development process of Example 1. FIG. 1 shows the infrared density of silver developed in the exposed areas, and FIG. 2 shows the infrared density of silver developed in the unexposed areas (fog), for a control element and an element containing a blocked development restrainer in accordance with this invention.

The term "blocked development restrainers" as used herein generally refers to development restrainers which contain a blocking group inactivating or rendering ineffective the development-restrainer capabilities of the compound. Upon cleavage of the blocking group from the molecule, such as by hydrolysis, etc., the compound can again function as a development restrainer. The blocked development restrainers of this invention have a blocking group designed to provide cleavage in an alkaline medium as encountered in a photographic development process.

Generally, the blocked development restrainers which are useful in accordance with this invention are azoles which cleave in alkaline solution to yield mercaptoazoles which are diffusible in alkaline solution.

The useful compounds generally have the formula:

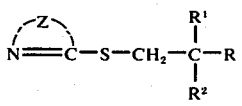

wherein R, $R^1$, $R^2$ and Z are as defined above. The heterocycle groups formed by Z preferably include groups wherein the heterocyclic atoms (i.e., atoms other than carbon) are members of a single herterocyclic ring, as contrasted with compounds containing fused or condensed heterocyclic rings in which the heterocyclic atoms are members of more than one heterocyclic ring. Typical simple heterocyclic nitrogen compounds include triazoles (e.g., 1,2,4-triazoles, benzotriazoles, etc.), diazoles (e.g., imidazoles, benzimidazoles, etc.), pyrimidines, monoazoles (e.g., benzoxazoles, benzothiazoles, etc.) and the like.

In preferred embodiments, the blocked development restrainers of this invention contain a tetrazole nucleus, and preferably a phenyl-substituted tetrazole nucleus.

A typical useful compound according to this embodiment is as follows:

Compound I

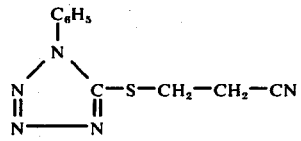

The blocked development restrainers can be made by methods known in the art, such as by the processes described by Allen and Humphlett, "The Thermal Reversability of the Michael Reaction", *Canadian Journal of Chemistry*, Vol. 44, 1966, pp. 2315–2321; particularly useful procedures are described on pp. 2320 and 2321 in Method B and Method C(iii). As an example of one specific preparation, Compound I can be prepared by reacting 1-phenyl-2-tetrazoline-2-thione with acrylonitrile in glacial acetic acid by Method B. In this procedure for making Compound I, the reaction mixture is maintained at 70°–80° C. for 30 minutes and then boiled for 10 minutes. Most of the solvent is removed under reduced pressure. When residue is allowed to stand overnight, the crude product crystallizes.

The cleavage or blocking of the compounds of this invention appear to function by a reverse Michael reaction. The use of the ethylene linkage separating the group:

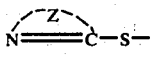

from the remainder of the molecule appears to give the necessary resonance structure to provide for timely release of the development-restrainer moiety. Generally, the release of the development restrainer is achieved, in accordance with the present invention, by contact with an alkaline medium, however, it is also possible to aid or achieve cleavage by elevating the temperature, etc.

The release mechanism appears to be different in kind from the release mechanism of compounds such as, for example, the carboxymethylmercapto-substituted heterocyclic nitrogen compounds of U.S. Pat. No. 2,819,965. Generally, the carboxymethylmercapto-substituted compounds require an acid-catalyzed reaction in the presence of a heavy metal salt; this apparently accounts for their usefulness as antifoggants for photographic emulsions subjected to extreme storage conditions.

The photographic elements of this invention can contain the blocked development restrainer in any concentration necessary for the intended purpose, depending on the location of the development restrainer and the problems encountered. In certain embodiments where the blocked development restrainer is associated with a silver halide emulsion layer, the blocked development restrainer can be used at a concentration of at least 0.005 mole/mole of silver in said layer and preferably at a concentration of at least 0.1 mole/mole of silver up to equimolar amounts. In certain embodiments where the compound cleaves to provide a 1-phenylmercaptotetrazole, the blocked development restrainer is preferably used at concentrations of from 0.02 to 0.1 mole/mole of silver. The blocked development restrainer can be incorporated in the photographic element where it is in the layer containing the silver halide emulsion or in an adjacent layer associated therewith. In certain embodiments, the blocked development restrainer is used in association with only one layer of a multiple-layer silver halide element. In still other embodiments, it can be contained in a layer which is placed in intimate contact with the photographic element during processing. The layers of the photographic elements can be hardened during or after coating, as known in the art.

In certain embodiments, the blocked development restrainers of this invention are incorporated in a cover sheet or a receiver element which is in intimate association with the photographic element during processing. Cover sheets and receiver elements used for this purpose can have an acid layer, which is used to neutralize the pH of the processing composition, with an overcoated timing layer which provides for a predetermined time for processing before the processing composition is neutralized. When the blocked development restrainers are used in this embodiment, they can be coated in the timing layer, on top of the timing layer, or behind the timing layer, depending upon the amount of time desired before the action of the development restrainer is desired.

The blocked development restrainers can be incorporated in the photographic element by dispersing them in the carrier layer by techniques available in the art. In certain preferred embodiments the blocked development restrainers are first dissolved in a high-boiling solvent, such as a water-soluble coupler solvent, and then dispersed in the carrier material. Typical useful coupler solvents are moderately polar solvents such as tri-o-cresyl phosphate, di-n-butyl phthalate, diethyl lauramide,2,4-diamylphenol, liquid dye stabilizers such as described in an article entitled "Improved Photographic Dye Image Stablizer-Solvent", *Product Licensing Index*, Vol. 83, March, 1971, and the like.

The blocked development restrainers of this invention can generally be used in association with any silver halide emulsion. However, they are preferably used in association with a negative silver halide emulsion, i.e., a silver halide emulsion which develops in the areas of exposure, especially when they are located in close proximity to the silver halide emulsion layers. The silver halide emulsion can have various image dye-providing materials in association therewith to produce in image record with image dyes. Photographic color couplers including compounds as described in U.S. Pat. Nos. 3,046,129 by Graham and 3,620,747 by Marchant, both incorporated herein by reference, can be used to form the image dye when color developers are used in the process.

The term "image dye-providing material" as used herein is understood to refer to those compounds which either (1) do not require a chemical reaction to form the image dye or (2) undergo reactions encountered in photographic imaging systems to produce an image dye, such as with color couplers, oxichromic compounds and the like. The first class of compounds is generally referred to as preformed image dyes and includes shifted dyes, etc., while the second class of compounds is generally referred to as dye precursors.

The terms "initially diffusible" and initially immobile" as used herein refer to compounds which are incorporated in the photographic element and, upon contact with an alkaline processing solution, are substantially diffusible or substantially immobile, respectively.

The image dye-providing materials in one preferred embodiment where negative silver halide emulsions are used, can be initially mobile image dye-providing materials such as those used in image-transfer photographic elements. Typical useful, initially mobile image dye-providing materials include dye developers as disclosed in U.S. Pat. Nos. 2,983,606; 3,255,001 and the like; oxichromic developers which undergo chromogenic oxidation to form image dyes as disclosed in U.S. Ser. No. 308,869 filed Nov. 22, 1972, now U.S. Pat. No. 3,880,658 issued Apr. 29, 1975; shifted indophenol dye developers as disclosed in U.S. Pat. No. 3,854,945 by Bush and Reardon issued Dec. 17, 1974; metalized dye developers as disclosed in U.S. Pat. Nos. 3,482,972; 3,544,545; 3,551,406 and 3,563,739; and the like: all of which are incorporated herein by reference.

The image dye-providing material in another preferred embodiment, especially when negative silver halide emulsions are used, is an initially immobile image dye-providing material. Preferably, the initially immobile image dye-providing material is a positive-working immobile photographic compound such as disclosed in Hinshaw and Condit, U.S. Ser. No. 326,628 filed January 26, 1973, which is incorporated herein by reference.

In another embodiment, immobile image dye-providing compounds can be used in association with silver halide emulsions wherein said compounds undergo oxidation followed by hydrolysis to provide an image-wise distribution of a mobile image dye. Compounds of this tyie can be used with negative emulsions to form positive image records in the exposed photographic element, or they can be used with direct-positive or reversal emulsions to form positive transfer images such as in an image-transfer film unit. Typical useful immobile image dye-providing compounds are disclosed in Canadian Pat. No. 602,607 by Whitmore et al. issued Aug. 2, 1960, U.S. Ser. Nos. 351,673 by Fleckenstein et al. published as trial voluntary protest No. B 351,673 on Jan. 28, 1975 and 351,700 by Fleckenstein issued as U.S. Pat. No. 3,928,312 on Dec. 13, 1975, and U.S. Pat. Nos. 3,698,897 by Gompf et al., 3,728,113 by Becker et al., 3,725,062 by Anderson et al., 3,227,552 by Whitmore, 3,443,939; 3,443,940 and 3,443,941, and the like, all of which are incorporated herein by reference.

In still other embodiments, the blocked development restrainers can be used in photographic elements containing a layer comprising a negative silver halide emulsion and having an adjacent layer containing physical development nuclei associated with an image dye-providing material. Typical photographic elements of this type are disclosed in U.S. Pat. No. 3,227,551 (col. 6 and 7) and British Pat. No. 904,364 (p. 19), which are incorporated herein by reference.

The silver halide emulsions used in the photographic elements of this invention can comprise silver chloride, silver bromide, silver bromoiodide, silver chlorobromoiodide and the like, or mixtures thereof. The emulsions may be coarse- or fine-grain and can be prepared by any of the well-known procedures, e.g., single-jet emulsions, double-jet emulsions, such as Lippmann emulsions, ammoniacal emulsions, thiocyanate or thioether ripened emulsions such as those described in U.S. Pat. Nos. 2,222,264 by Nietz et al., 3,320,069 by Illingsworth and 3,271,157 by McBride. Surface-image emulsions can be used or internal-image emulsions can be used such as those described in U.S. Pat. Nos. 2,592,250 by Davey et al., 3,206,313 by Porter et al. and 3,447,927 by Bacon et al. The emulsions may be regular-grain emulsions such as the type described in Klein and Moisar, *J. Phot. Sci.*, Vol. 12, No. 5, September/October, 1964, pp. 242–251. If desired, mixtures of surface- and internal-image emulsions can be used as described in Luckey et al., U.S. Pat. No. 2,996,382.

Negative-type emulsions can be used or direct-positive emulsions can be used such as those described in U.S. Pat. Nos. 2,184,013 by Leermakers, 2,541,472 by Kendall et al., 3,367,778 by Berriman, 3,501,307 by Illingsworth et al. issued Mar. 17, 1970, 2,563,785 by Ives, 2,456,953 by Knott et al., 2,861,885 by Land, 3,761,276 by Evans, 3,761,266 by Milton, 3,761,267 by Gilman et al., 3,736,140 by Collier et al., and 3,730,723 by Gilman et al, U.S. Ser. No. 154,155 by Gilman et al. filed June 17, 1971, now abandoned, and British Pat. No. 723,019 by Schouwenaars.

The blocked development restrainers in accordance with this invention are preferably used in photographic elements designed for one-step processing or processing with a single alkaline liguid composition. The development of the silver halide layers can proceed for a specified period with timely hydrolysis of the compound to provide a development restrainer which assists in shutting down further development and preventing interaction of reactants with the wrong silver halide layer.

In certain preferred embodiments, the blocked development restrainers are used in the photographic element of an image-transfer film unit. The photographic element can be used in image-transfer film units as described, for example, in U.S. Pat. Nos. 2,543,181; 2,983,606; 3,227,550; 3,227,552; 3,415,645; 3,415,644; 3,415,646 and 3,635,707, Canadian Pat. No. 674,082, and Belgian Pat. Nos. 757,959 and 757,960, both issued Apr. 23, 1971. In highly preferred embodiments, the blocked development restrainers are used in the photographic element of an image-transfer film unit which is designed to be processed with a single processing solution, and the resulting positive image is viewed through a transparent support and against an opaque background.

The blocked development restrainers of this invention are advantageously used in image-transfer elements wherein it is desired to allow development to occur for a predetermined period of time, followed by inhibition of further development. The blocked development restrainers are generally useful in image-transfer film units which comprise:

1. a photosensitive element comprising a support having thereon at least one layer containing a silver halide emulsion having associated therewith an image dye-providing material and preferably at least three layers which contain, respectively, a blue-sensitive silver halide emulsion, a green-sensitive silver halide emulsion and a red-sensitive silver halide emulsion;

2. an image-receiving layer which can be located on a separate support and superposed on said support containing said silver halide emulsions layers or, preferably, it can be coated on the same support adjacent to the photosensitive silver halide emulsion layers; and 3. means containing an alkaline processing composition adapted to discharge its contents within said film unit.

Where the receiver layer is coated on the same support with the photosensitive silver halide layers, the support is preferably a transparent support, an opaque layer is preferably positioned between the image-receiving layer and the photosensitive silver halide layer, and the alkaline processing composition preferably contains an opacifying substance such as carbon or a pH-indicator dye which is discharged into the film unit between a dimensionally stable support or cover sheet and the photosensitive element.

In certain embodiments, the cover sheet can be superposed or adapted to be superposed on the photosensitive element. The image-receiving layer can be located on the cover sheet. In certain preferred embodiments where the image-receiving layer is located in the photosensitive element, a neutralizing layer is located on the cover sheet.

A means for containing the alkaline processing solution can be any means known in the art for this purpose, including rupturable containers positioned at the point of desired discharge of its contents into the film unit and adapted to be passed between a pair of juxtaposed rollers to effect discharge of the contents into the film unit, frangible containers positioned over or within the photosenitive element, hypodermic syringes, and the like.

It is known in the art that neutralizing layers containing acidic materials, such as polymeric acids, monomeric acids, hydrolyzable materials and the like, can be positioned within an image-transfer film unit to effect shutdown of development of silver halide and transfer of the image dye-providing substance. Neutralizing layers can also be used in the film units of the present invention, including acid layers positioned behind timing layers to delay neutralization of the element, acid layers positioned near the image-receiving layer, acid layers on a cover sheet used to distribute the processing composition uniformly over the photosensitive element, acid layers within the photosensitive element, and the like. However, since most image dye-providing materials transfer at much higher rates in a highly alkaline medium than in a neutral medium, it is desirable to delay neutralization until after the image dye-providing material has completed the necessary transfer. It is apparent that the image dye-providing materials will transfer through adjacent silver halide layers in an environment wherein interactions can still occur. The blocked development restrainers of this invention can be used effectively to reduce the interactions of diffusible material with the adjacent layers to prevent contamination and still allow the film unit to be maintained in a highly alkaline medium for sufficient time to achieve high densities of transferred image dye-providing material.

The invention can be further demonstrated by the following examples.

Examples 1–3 demonstrate a preferred embodiment wherein the blocked development restrainers are used in a photographic element containing a negative silver halide emulsion having associated therewith an initially diffusible oxichromic compound. Example 1 also shows comparisons with prior-art compounds.

EXAMPLE 1

A photographic element is prepared by coating layers in order on a support as follows:

1. transparent support;

2. layer containing 125 mg./ft.$^2$ of gelatin and 35 mg./ft$^2$ of the oxichromic developer:

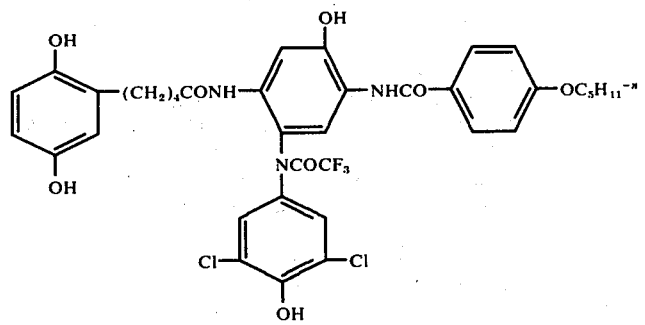

dissolved in diethyl lauramide at 24 mg./ft.$^2$;

3. layer containing 200 mg./ft.$^2$ of gelatin, a negative silver halide emulsion at 100 mg. of Ag/ft.$^2$, 10 mg./ft.$^2$ of 1-phenyl-3-pyrazolidone, and 0.79 millimole/ft.$^2$ of the hydrolyzable development restrainer per Table 1;

4. layer containing 70 mg./ft.$^2$ of gelatin;

Samples of the elements are evaluated for the amount and rate of silver developed in the photographic silver halide negative (Procedure A) and the transferred dye image and developed silver after a 30-second transfer process (Procedure B).

Procedure A

An infrared reflectance densitometer is used to monitor the silver development as a function of time. This is achieved by measuring the development of silver through the transparent support of an unexposed sample (fog development) and a sample which has been light-flashed (image development). Development is accomplished by spreading a viscous activating solution having 40 g./l. potassium hydroxide and 30 g./l. hydroxyethyl cellulose.

The unexposed sample is monitored for times up to 5 min., and the exposed sample is monitored for 14 sec. This procedure gives data which are illustrated for one of the compounds of the invention as compared with a control which does not contain the blocked development restrainer by FIG. 1 and 2. The total silver density developed in both the exposed (14-sec. development time) and the unexposed (5-min. development time) samples is recorded in Table 1.

Procedure B

To evaluate the transferred dye image and developed silver of the above prepared elements, separate samples are exposed through a graduated-density test object and activated with a viscous solution having 65 g./l. potassium hydroxide and 30 g./l. hydroxyethyl cellulose while in contact with a receiving element comprising a supported layer of the dye mordant octadecyltributylammonium bromide (200 mg./ft.$^2$) in di-n-butylphthalate (200 mg./ft$^2$) and gelatin (700 mg./ft.$^2$). After 30 sec., the receiver is separated from the negative element. The amount of developed silver is measured after the 30-sec. transfer period and is recorded in Table 1. The resulting image density on the receiver is measured and is also recorded in Table 1.

Table 1

| | Procedure A | | Procedure B 30-sec. Dev. and Transfer | | | |
|---|---|---|---|---|---|---|
| | IR Density of Developed Silver | | Dye Density on Receiver | | Silver (mg.) Dev. on Negative | |
| Compound | Exposed | Unexposed | $D_{max}$ | $D_{min}$ | $D_{max}$ | $D_{min}$ |
| phenylmercaptotetrazole* | 76 | 1 | 1.79 | 1.33 | 9 | 2 |
| none (control) | 97 | 75 | 1.46 | .13 | 24 | 8 |
| I** | 90 | 18 | 1.68 | .13 | 14 | 1 |
| none (control) | 98 | 77 | 1.64 | .13 | 24 | 3 |
| 5-β-acetylethylthio-1-phenyl-1,2,3,4-tetrazole | 7 | 0 | 1.83 | 1.78 | 2 | 0 |
| none (control) | 98 | 65 | 1.64 | .13 | 19 | 2 |

*.0079 mmole/ft.$^2$
**Compound I = 5-(2 cyanuethylthio)-1 phenyltetrazale which is a compound of the invention.

The data from the above Table 1 are then standardized to a single control. They are recorded in Table 2 below.

Table 2

| | Procedure A | | Procedure B 30-sec. Dev. and Transfer | | | |
|---|---|---|---|---|---|---|
| | IR of Density of Total Silver Dev. | | Dye Dens. | | Dev. Silver (mg.) | |
| Compound | Exposed | Unexposed | $D_{max}$ | $D_{min}$ | $D_{max}$ | $D_{min}$ |
| none(control) | 98 | 77 | 1.64 | .13 | 24 | 3 |
| phenylmercaptotetrazole | 76 | 1 | 2.0 | 1.3 | 9 | .8 |
| I | 88 | 15 | 1.70 | .13 | 14 | 0.9 |
| 5-β-acetylethylthio-1-phenyl-1,2,3,4-tetrazole | 7 | 0 | 1.83 | 1.78 | 3 | 0 |

From the data listed in Tables 1 and 2, one can observe that the compounds of the invention are effective in reducing silver development in the unexposed sample without substantially affecting development in the exposed sample (Procedure A). The data from Procedure B illustrate that increased maximum dye density is obtained without increasing density in the fully exposed regions, i.e., Dmin. This is explained by the fact that upon activation the oxichromic developer in Layer 2 is solubilized and begins to diffuse to the receiver. The developing silver in Layer 3 causes the imagewise immobilization of the compound by oxidation. The 1-phenyl-3-pyrazolidone contained in Layer 3 acts as an auxiliary developer to aid in imagewise oxidation. If the silver halide emulsion in Layer 3 develops in the unexposed areas before all the diffusible oxichromic compound has migrated to the receiver, it will cause a loss in maximum dye density. Further, if the development of image silver has been inhibited, it will not be effective in immobilizing the oxichromic dye compound, and undesirable dye will transfer in areas of maximum exposure, as exhibited by the 5-B-acetylethylthio-1-phenyl-1,2,3,4-tetrazole which apparently hydrolyzes so quickly that development is substantially inhibited.

EXAMPLE 2

An integral color transfer photographic element is prepared as follows (the full identification of certain components follows the example):

1. transparent polyethylene terephthalate support;
2. dye mordant layer containing gelatin at 100 mg./ft.$^2$ and copoly[styrene-N-benzyl-N,N-dimethyl-N-(3-maleimidopropyl)ammonium chloride] at 200 mg./ft.$^2$;
3. layer containing titanium dioxide at 2000 mg./ft.$^2$ and gelatin at 200 mg./ft.$^2$;
4. layer containing carbon opacifying agent at 250 mg./ft.$^2$ and gelatin at 156 mg./ft.$^2$;
5. layer containing gelatin at 75 mg./ft.$^2$, 2,5-disec-dodecylhydroquinone at 70 mg./ft.$^2$ and tricresyl phosphate at 23 mg./ft.$^2$;
6. layer containing a red-sensitive silver bromoiodide emulsion at 80 mg./ft.$^2$ based on silver, gelatin at 82 mg./ft.$^2$, OC-I at 43 mg./ft.$^2$ dissolved in diethyl lauramide at 29 mg./ft.$^2$, and 4-methylphenyl hydroquinone at 15 mg./ft.$^2$;
7. layer containing gelatin at 150 mg./ft.$^2$, 2,5-disec-dodecylhydroquinone at 70 mg./ft.$^2$ and a magenta filter dye at 30 mg./ft.$^2$ dissolved in diethyl lauramide at 50 mg./ft.$^2$;
8. layer containing a green-sensitive silver bromoiodide emulsion at 80 mg./ft.$^2$ based on silver, gelatin at 102 mg./ft.$^2$, OC-III at 63 mg./ft.$^2$ dissolved in diethyl lauramide at 39 mg./ft.$^2$, and 4-methylphenyl hydroquinone at 15 mg./ft.$^2$;
9. layer containing gelatin at 150 mg./ft.$^2$, 2,5-disec-dodecylhydroquinone at 70 mg./ft.$^2$ and a yellow filter dye at 100 mg./ft.$^2$ dissolved in diethyl lauramide at 28 mg./ft.$^2$;
10. layer containing a blue-sensitive silver bromoiodide emulsion at 100 mg./ft.$^2$ based on silver, gelatin at 124 mg./ft.$^2$, OC-II at 73 mg./ft.$^2$ dissolved in diethyl lauramide at 44 mg./ft.$^2$, and 4-metylphenyl hydroquinone at 15 mg./ft.$^2$;
11. layer containing gelatin at 50 mg./ft.$^2$.

A transparent cover sheet for the above element is prepared as follows:

1. transparent polyethylene terephthalate support;
2. layer containing gelatin at 900 mg./ft.$^2$, polyacrylic acid at 900 mg./ft.$^2$ and imidazole at 760 mg./ft.$^2$;
3. layer containing cellulose acetate at 1140 mg./ft.$^2$ and copoly(styrene-maleic anhydride) at 60 mg./ft.$^2$.

The photographic element is exposed through a multicolor graduated-density test object, the transparent cover sheet superposed on the element, and a pod containing an opaque processing composition is ruptured to discharge between the cover sheet and the photosensitive element by passing the film unit through juxtaposed rollers having a gap of about 8 mils.

The processing composition is as follows:

| | |
|---|---|
| potassium hydroxide | 40 g./l. |
| hydroxyethyl cellulose | 25 g./l. |
| potassium bromide | 80 g./l. |
| α-benzylpicolinium bromide | 10 g./l. |
| bis-methylsulfonmethane | 2 g./l. |
| carbon | 40 g./l. |
| water to 1 liter | |

After 4 min., the backing sheet is separated from the exposed element and the element is immersed in a 2% sodium persulfate bath for 1 min., washed for 10 min., and dried.

The samples processed are as follows:

| | |
|---|---|
| Element 1: | control (as above) |
| Element 2: | same as control except each of Layers 7 and 9 contains 5 mg./ft.$^2$ of Compound I dissolved in 15 mg./ft.$^2$ of tricresyl phosphate |
| Element 3: | same as control except each of Layers 6 and 8 contains 5 mg./ft.$^2$ of Compound I dissolved in 15 mg./ft.$^2$ of tricresyl phosphate |

Table 3

| | $D_{max}$ | | | $D_{min}$ | | |
|---|---|---|---|---|---|---|
| Element | Red | Green | Blue | Red | Green | Blue |
| 1 | 0.56 | 0.78 | 1.18 | 0.24 | 0.32 | 0.36 |
| 2 | 1.37 | 1.71 | 2.15 | 0.22 | 0.24 | 0.35 |
| 3 | 1.52 | 1.81 | 2.20 | 0.22 | 0.26 | 0.36 |

OC-II is:

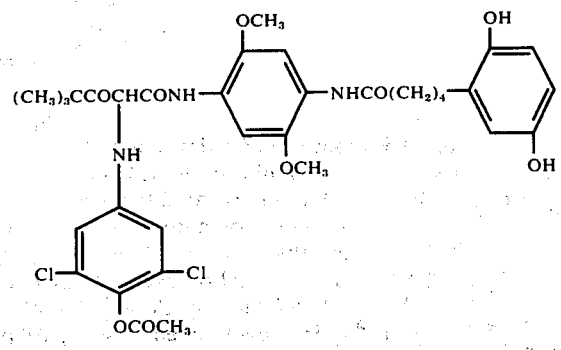

OC-III is:

-continued

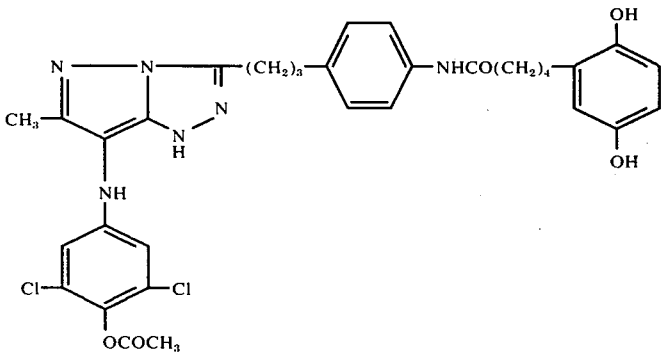

OC-I is the oxichromic developer used in Example 1, Layer 2.

The oxichromic compounds used in this example and the following examples can be prepared as described in Lestina and Bush, U.S. Ser. No. 308,869 filed Nov. 22, 1972.

EXAMPLE 3

An integral color transfer photograhic element is prepared as follows (the full identification of certain components follows the example):

1. transparent polyethylene terephthalate support;
2. dye mordant layer containing gelatin at 100 mg./ft.$^2$, copoly[styrene/N-benzyl-N,N-dimethyl-N-(3-maleimidopropyl)-ammonium chloride] at 200 mg./ft.$^2$ and a nitroxyl oxidant at 200 mg./ft.$^2$;
3. layer containing titanium dioxide at 2000 mg./ft.$^2$ and gelatin at 200 mg./ft.$^2$;
4. layer containing carbon opacifying agent at 250 mg./ft.$^2$ and gelatin at 156 mg./ft.$^2$;
5. layer containing gelatin at 75 mg./ft.$^2$, 2,5-di-sec-dodecylhydroquinone at 70 mg./ft.$^2$ and tricresyl phosphate at 23 mg./ft.$^2$;
6. layer containing a red-sensitive silver bromoiodide emulsion at 70 mg./ft.$^2$ based on silver, gelatin at 230 mg./ft.$^2$, OC-IV at 42 mg./ft.$^2$ dissolved in 2-cyanoethylthio)-lauramide at 73 mg./ft.$^2$, 5-(2:cyanoethylthio)-1-phenyltetrazole at 5 mg./ft.$^2$ dissolved in tricresyl phosphate at 15 mg./ft.$^2$ and 5,6,7,8-tetrahydro-5,8-methano-1,4-naphthalenediol at 10 mg./ft.$^2$;
7. layer containing gelatin at 300 mg./ft.$^2$2,5-di-sec-dodecylhydroquinone at 70 mg./ft.$^2$ and a magneta filter dye at 30 mg./ft.$^2$ dissolved in diethyl lauramide at 50 mg./ft.$^2$;
8. layer containing green-sensitive silver bromoiodide emulsion at 70 mg./ft.$^2$ based on silver, gelatin at 230 mg./ft.$^2$, OC-V at 54 mg./ft.$^2$ dissolved in diethyl lauramide at 64 mg./ft.$^2$, 5-(2-cyanoethylthio)-1-phenyltetrazole at 5 mg./ft.$^2$ dissolved in tricresyl phosphate at 15 mg./ft.$^2$ and 5,6,7,8-tetrahydro5,8-methano-1,4-naphthalenediol at 10 mg./ft.$^2$;
9. layer containing gelatin at 300 mg./ft.$^2$, 2,5-di-sec-dodecylhydroquinone at 70 mg./ft.$^2$ and a yellow filter dye at 100 mg./ft.$^2$ dissolved in diethl lauramide at 28 mg./ft.$^2$;
10. layer containing a blue-sensitive silver bromoidiode emulsion at 70 mg./ft.$^2$ based on silver, gelatin at 210 mg./ft.$^2$, OC-VI at 64 mg./ft.$^2$ dissolved in diethyl lauramide at 106 mg./ft.$^2$, 5-(2-cyanoethylthio)-1-phenyltetrazole at 5 mg.ft.$^2$ dissolved in tricresyl phosphate at 15 mg./ft.$^2$ and 5,6,7,8-tetrahydro-5,8-methano-1,4-naphthalenediol at 10 mg./ft.$^2$;
11. layer containing gelatin at 50 mg./ft.$^2$.

A transparent cover sheet for the above element is prepared as follows:

1. transparent polyethylene terephthalate support;
2. layer containing gelatin at 900 mg./ft.$^2$, polyacrylic acid at 900 mg./ft.$^2$ and imidazole at 760 mg./ft.$^2$;
3. layer containing cellulose acetate at 1140 mg./ft.$^2$ and copoly(styrene-maleic anhydride) at 60 mg./ft.$^2$.

The photographic element is exposed through a multi-color, graduated-density test object, the transparent cover sheet superposed on the element, and a pod containing an opaque processing composition is ruptured to discharge between the cover sheet and the photosensitive element by passing the film unit through juxtaposed rollers having a gap of about 8 mils.

The processing composition is as follows:

| | |
|---|---|
| potassium hydroxide | 51 g./l. |
| hydroxyethyl cellulose | 30 g./l. |
| potassium bromide | 40 g./l. |
| α-benzylpicolinium bromide | 15 g./l. |
| 5,6,7,8-tetrahydro-5,8-methano-1,4-naphthalenediol | 15 g./l. |
| carbon | 40 g./l. |

After about 1 to 2 min. a well-defined color image with excellent color reproduction is viewed through the transparent support of the integral element.

The nitroxyl oxidant is the compound:

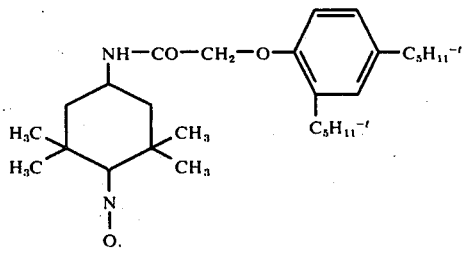

The nitroxyl oxidant can be made by reacting the respective ballasted acyl chloride with the 4-amino-2,2,6,6-tetramethylpiperidine-1-oxyl.

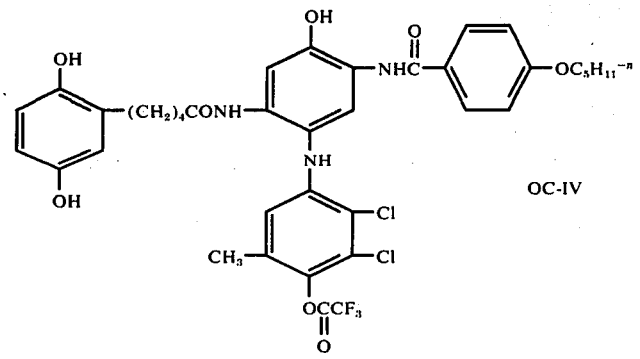

OC-IV

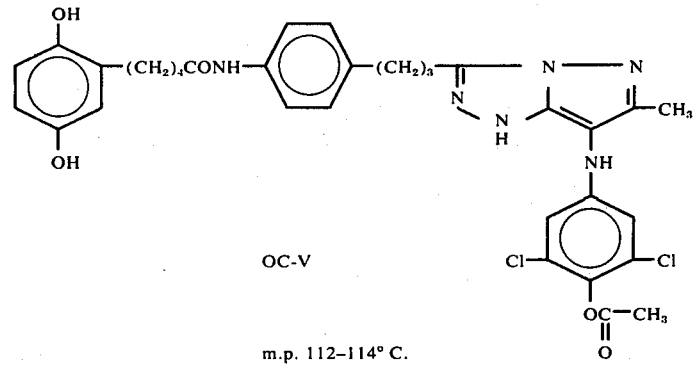

OC-V m.p. 112–114° C.

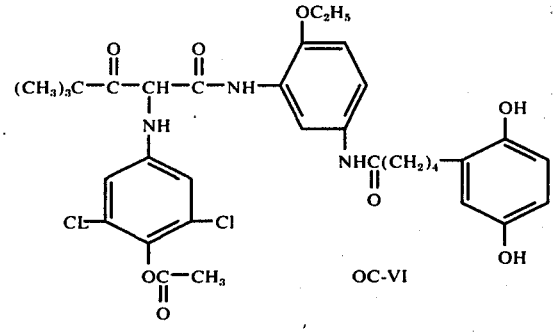

OC-VI

Examples 4 and 5 demonstrate a preferred embodiment wherein the blocked development restrainers are used in a photographic element containing a negative silver halide emulsion having associated therewith positive-working, initially immobile, dye-releasing compounds.

EXAMPLE 4

A multicolor photographic element is prepared by coating a photographic film support with the following layers in order from the support:

1. layer containing a red-sensitive negative silver halide emulsion (1.2 $\mu$ average grain AgBr) at 150 mg. silver/ft.$^2$, gelatin at 170 mg./ft.$^2$, Dye Releaser I at 60 mg./ft.$^2$ dissolved in diethyl lauramide at 30 mg./ft.$^2$, 1-phenyl-3-pyrazolidone at 15 mg./ft.$^2$, and 5-(2-cyanoethylthio)-1-phenyltetrazole at 12 mg./ft.$^2$ dissolved in tricresyl phosphate at 36 mg./ft.$^2$;

2. layer containing gelatin at 70 mg./ft.$^2$ and 2,5-disecdodecylhydroquinone at 70 mg./ft.$^2$ dissolved in diethyl lauramide at 23 mg./ft.$^2$;

3. layer containing a green-sensitive negative silver halide emulsion (1.2 $\mu$ average grain AgBr) at 150 mg. silver/ft.$^2$, gelatin at 170 mg./ft.$^2$, Dye Releaser II at 45 mg./ft.$^2$ dissolved in diethyl lauramide at 23 mg./ft.$^2$, 1-phenyl-3-pyrazolidone at 15 mg./ft.$^2$, and 5-(2-cyanoethylthio)-1-phenyltetrazole at 12 mg./ft.$^2$ dissolved in tricresyl phosphate at 36 mg./ft.$^2$;

4. layer containing gelatin at 70 mg./ft.$^2$, 2,5-di-sec-dodecylhydroquinone at 70 mg./ft.$^2$ dissolved in diethyl lauramide at 23 mg./ft.$^2$, and Carey Lea silver at 17 mg./ft.$^2$;

5. layer containing a blue-sensitve negative silver halide emulsion (1.2 $\mu$ average grain AgBr) at 150 mg./ft.$^2$, gelatin at 170 mg./ft.$^2$, Dye Releaser III at 70 mg./ft.$^2$ dissolved in diethyl lauramide at 35 mg./ft.$^2$, 1-phenyl-3-pyrazolidone at 15 mg./ft.$^2$, and 5-(2-cyanoethylthio)-1-phenyltetrazole at 12 mg./ft.$^2$ dissolved in tricresyl phosphate at 36 mg./ft.$^2$;

6. layer containing gelatin at 50 mg./ft.$^2$.

The photographic element is exposed to a multicolor, graduated-density test object and processed at room temperature with a various aqueous solution comprising 50 g. potassium hydroxide and 30 g. hydroxyethyl cellulose/1. of water, while in contact with a mordanted receiver comprising a polyethylene-coated paper support coated with a layer containing copoly[styrene--N-benzyl-N,N-dimethyl-N-(3-maleimidopropyl)ammonium chloride] at 200 mg./ft.$^2$ and gelatin at 200 mg./ft.$^2$ and overcoated with a layer containing 50 mg./ft.$^2$ gelatin.

Upon separation of the photographic element from the receiver, the receiver is washed, and a well-defined multicolor reproduction of the test object is obtained.

The compounds referred to in this example and the following example are as follows:

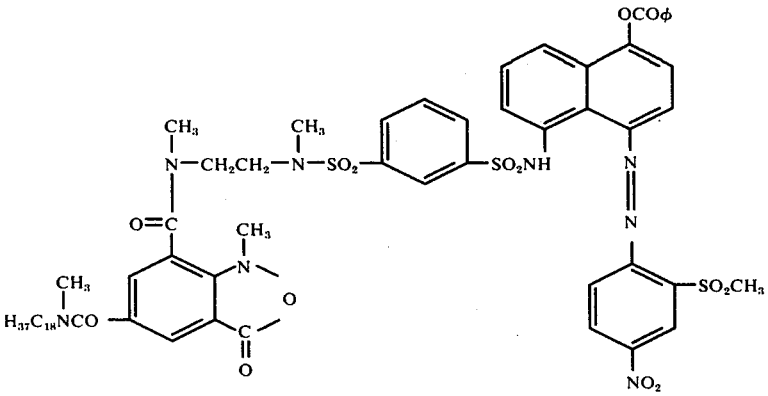

Dye Releaser I

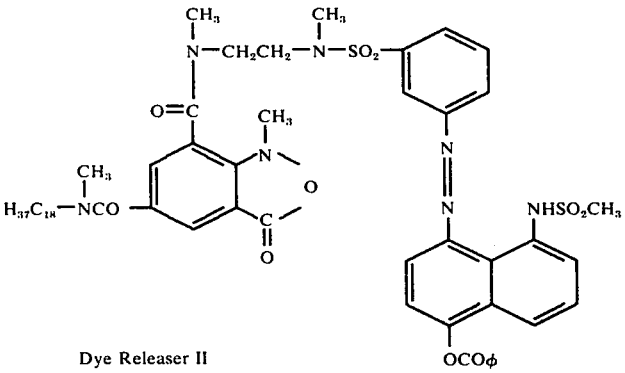

Dye Releaser II

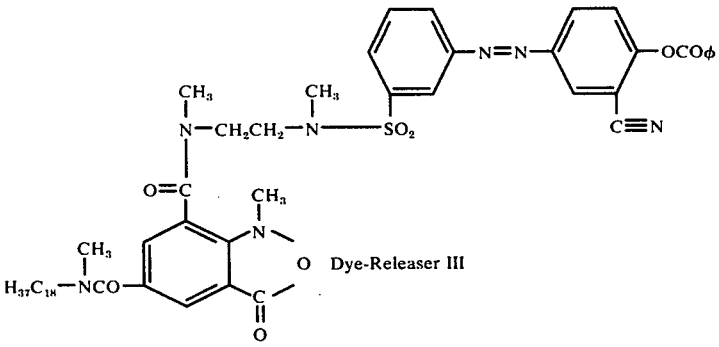

Dye-Releaser III

The dye-releaser compounds can be prepared as generally described in Hinshaw and Condit, U.S. Ser. No. 326,628 filed Jan. 26, 1973.

EXAMPLE 5

An integral color transfer photographic element is prepared by coating a transparent film support with the following layers in order from the support:

1. layer containing the mordant copoly[styrene-N-benzyl-N,N-dimethyl-N-(3-maleimidopropyl)ammonium chloride] at 200 mg./ft.$^2$ and gelatin at 100 mg./ft.$^2$;

2. layer containing titanium dioxide at 2000 mg./ft.$^2$ nd gelatin at 200 mg./ft.$^2$;

3. layer containing carbon at 250 mg./ft.$^2$ and gelatin at 156 mg./ft.$^2$;

4. layer containing a red-sensitive negative silver halide emulsion (1.2 $\mu$ average grain AgBr) at 150 mg. silver/ft.$^2$ gelatin at 170mg./ft.$^2$, Dye releaser I at 60 mg./ft.$^2$ dissolved in diethyl lauramide at 30 mg./ft.$^2$, 1-phenyl-3-pyrazolidone at 15 mg./ft.$^2$, and 5-(2-cyanoethylthio)-1-phenyltetrazole at 12 mg./ft.$^2$ dissolved in tricresyl phosphate at 36 mg./ft.$^2$;

5. layer containing gelatin at 70 mg./ft.$^2$ and 2,5-disecdodecylhydroquinone at 70 mg./ft.$^2$ dissolved in diethyl lauramide at 23 mg./ft.$^2$;

6. layer containing a green-sensitive negative silver halide emulsion (1.2 $\mu$ average grain AgBr) at 150 mg.

silver/ft.$^2$, gelatin at 170 mg./ft.$^2$, Dye Releaser II at 45 mg./ft.$^2$ dissolved in diethyl lauramide at 23 mg./ft.$^2$, 1-phenyl-3-pyrazolidone at 15 mg./ft.$^2$, and 5-(2-cyanoethylthio)-1-phenyltetrazole at 12 mg./ft.$^2$ dissolved in tricresyl phosphate at 36 mg./ft.$^2$;

7. layer containing gelatin at 70 mg./ft.$^2$, 2,5-di-sec-dodecylhydroquinone at 70 mg./ft.$^2$ dissolved in diethyl lauramide at 23 mg./ft.$^2$, and Carey Lea silver at 17 mg./ft.$^2$;

8. layer containing a blue-sensitive negative silver halide emulsion (1.2 $\mu$ average grain AgBr) at 150 mg./ft.$^2$, gelatin at 170 mg./ft.$^2$, Dye Releaser III at 70 mg./ft.$^2$ dissolved in diethyl lauramide at 35 mg./ft.$^2$, 1-phenyl-3-pyrazolidone at 15 mg./ft.$^2$, and 5-(2-cyanoethylthio)-1-phenyltetrazole at 12 mg./ft.$^2$ dissolved in tricresyl phosphate at 36 mg./ft.$^2$;

9. layer containing gelatin at 50 mg./ft.$^2$.

The photographic element is exposed to a multicolor graduated-density test object and processed at room temperature by rupturing a pod containing a viscous solution comprising 100 g. potassium hydroxide and 30 g. hydroxyethyl cellulose/1. of water between the photographic element and an opaque cover sheet with a good three-color image appearing in the receiving layer.

EXAMPLE 6

The development restrainers can be used in processing cover sheets which are in intimate contact with the photographic element during processing.

Processing cover sheets are prepared as follows:

Cover Sheet A (control)

A transparent polyethylene terephthalate support is coated in sequence with a neutralizing layer of poly(butyl acrylate-co-acrylic acid) (30/70 by weight) at 21.5 mg./m.$^2$ and then a timing layer of a 95/5 mixture of cellulose acetate (40% acetyl) and poly(styrene-co-maleic anhydride) at 4.3 g./m.$^2$.

Cover Sheet B

A cover sheet is prepared identical to Cover Sheet A except that the timing layer additionally contains 0.11 g./m.$^2$ of Compound I.

Each cover sheet is then used in processing an integral multicolor photosensitive element prepared by coating the following layers in the order given on a poly(ethylene terephthalate) film support (coverages in parentheses in g./m.$^2$ unless indicated otherwise):

1. image-receiving layer of poly(styrene-co-N-vinylbenzyl-N,N,N-trihexylammonium chloride) (2.2) and gelatin (2.2);
2. reflecting layer of titanium dioxide (21.5) and gelatin (2.2);
3. opaque layer of carbon black (2.7) and gelatin (1.7);
4. Compound A (0.54) dispersed in gelatin (0.73);
5. red-sensitive, direct-positive, internal-image gelatin-silver bromide emulsion (1.1 Ag, 1.1 gelatin), 5-sec-octadecylhydroquinone-2-sulfonic acid (8.0 g./mole silver), and fogging agent Compound D (1.5 g./mole silver);
6. interlayer of gelatin (0.54) and 2,5-di-sec-dodecylhydroquinone (1.1);
7. Compound B (0.65) dispersed in gelatin (1.05);
8. green-sensitive, direct-positive, internal-image gelatin-silver bromide emulsion (1.1 silver, 1.16 gelatin), 5-sec-octadecylhydroquinone-2-sulfonic acid (16.0 g./mole silver), and fogging agent Compound D (1.5 g./mole silver);
9. interlayer of gelatin (0.54) and 2,5-di-sec-dodecylhydroquinone (1.1);
10. Compound C (1.1) and gelatin (1.1);
11. blue-sensitive, direct-positive, internal-image gelatin-silver bromide emulsion (1.1 silver, 1.1 gelatin), 5-sec-octadecylhydroquinone-2-sulfonic acid (8.0 g./mole silver), and fogging agent Compound D (1.5 g./mole silver);
12. overcoat layer of gelatin (0.54) and hardener bis-(vinylsulfonylmethyl)ether (57.0 mg./m.$^2$).

Compound Identification

A

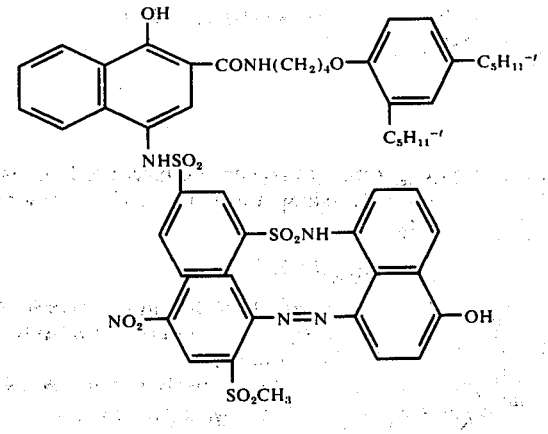

-continued

B

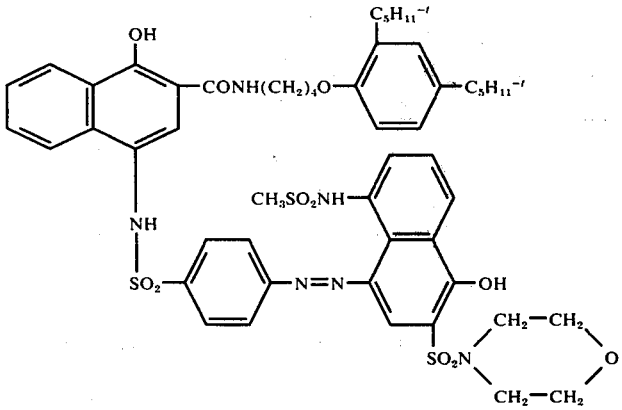

C

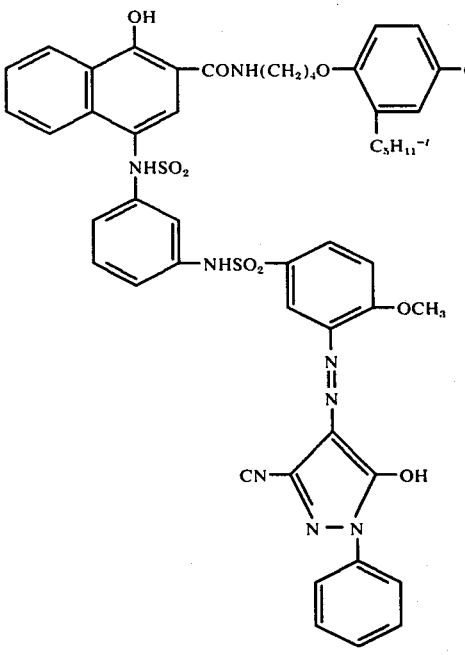

D

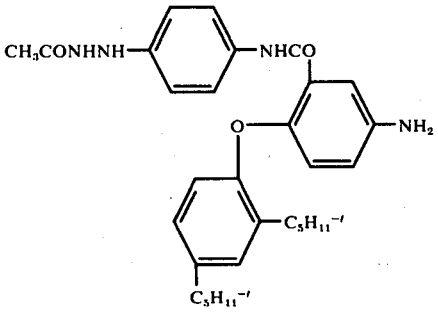

The photosensitive element is exposed to a tungsten light source through a graduated multicolor test object. The processing composition described below is employed in a pod and is spread between the photosensitive element and each sample of the above cover sheets by passing the transfer "sandwich" between a pair of juxtaposed rollers so that the liquid layer is about 70 μm. in thickness. Comparisons of the cover sheets are made at 15°, 22° and 38° C.

| Processing Composition | |
|---|---|
| potassium hydroxide | 47 g. |

-continued

| Processing Composition | |
|---|---|
| 4-hydroxymethyl-4-methyl-1-phenyl-3-pyrazolidone | 12 g. |
| 5-methylbenzotriazole | 4 g. |
| t-butylhydroquinone | 0.2 g. |
| methylhydroquinone | 0.2 g. |
| sodium sulfite | 0.9 g. |
| carboxymethylcellulose (sodium salt) | 44 g. |
| Tamol SN® dispersant | 8.8 g. |
| carbon black | 172 g. |
| water to make 1 liter | |

The data in the following table are obtained by reflection densitometry after the elements had been laminated together for about 3 hr.

Table

| Temp. °C. | Cover Sheet | Sensitometric Comparisons $D_{max}$ Red | Green | Blue | $D_{min}$ Red | Green | Blue |
|---|---|---|---|---|---|---|---|
| 15° | A (control) | 2.00 | 1.89 | 1.58 | .28 | .24 | .23 |
| | B | 2.08 | 2.00 | 1.60 | .26 | .22 | .21 |
| 22° | A | 2.22 | 2.15 | 1.85 | .30 | .28 | .27 |
| | B | 2.26 | 2.20 | 1.94 | .30 | .26 | .25 |
| 38° | A | 2.25 | 2.16 | 1.98 | .46 | .39 | .33 |
| | B | 2.25 | 2.17 | 1.97 | .40 | .30 | .29 |

The data show small but significant decreases in Dmin in all layers, particularly with high-temperature processing when a small amount of the blocked mercaptotetrazole derivative is incorporated in the cover sheet. At the lower temperatures a slight increase in Dmax also occurs.

Although the invention has been described in considerable detail with particular reference to certain preferred embodiments thereof, variations and modifications can be effected within the spirit and scope of the invention.

We claim:

1. A photographic element comprising a support and at least one layer thereon containing a silver halide emulsion having associated therewith a blocked development restrainer of the formula:

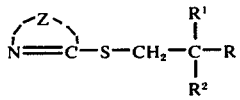

wherein Z represents the nonmetallic atoms necessary to form a nucleus which completes a 5- or 6-membered heterocyclic ring on said structure; R is a cyano grup; and $R^1$ and $R^2$ can each be hydrogen atoms, alkyl groups or aryl groups, provided that at least one of $R^1$ and $R^2$ is a hydrogen atom.

2. A photographic element according to claim 1 wherein said $R^1$ and $R^2$ of said blocked development restrainer are hydrogen atoms.

3. A photographic element according to claim 1 wherein said blocked development restrainer has the formula:

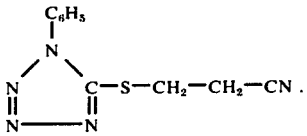

4. A photographic element according to claim 1 wherein said blocked development restrainer has the formula:

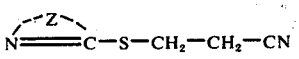

wherein Z represents the nonmetallic atoms necessary to form a nucleus which completes a 5- or 6-membered ring and which, together with said sulfur atom, provides a silver halide development restrainer upon cleavage from the remainder of the molecule.

5. A photographic element according to claim 1 wherein said layer containing a silver halide emulsion has at least 0.005 mole of said blocked development restrainer associated therewith per mole of silver in said layer.

6. A photographic element according to claim 1 wherein said silver halide emulsion is a negative silver halide emulsion.

7. A photographic element according to claim 1 wherein Z of said blocked development restrainer represents the atoms which form an uncharged tetrazole ring.

8. A photographic element according to claim 1 wherein aid layer containing said silver halide emulsion has associated therewith an image dye-providing material.

9. A photographic element according to claim 1 wherein said layer containing said silver halide emulsion has associated therewith an initially mobile, image dye-providing material.

10. A photographic element according to claim 1 wherein aid layer containing said silver halide emulsion has associated therewith a positive-working, initially immobile, image dye-providing material.

11. A photographic element comprising a support and at least one layer thereon containing a silver halide emulsion having associated therewith a blocked development restrainer of the formula:

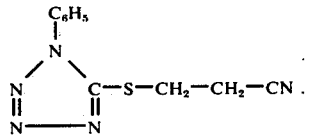

12. A photographic element according to claim 11 wherein said silver halide emulsion is a negative silver halide emulsion.

13. A photographic element according to claim 11 wherein said layer containing said silver halide emulsion has associated therewith an image dye-providing material.

14. In an image-transfer film unit comprising:

a. a photosensitive element comprising a support having thereon at least one layer containing a silver halide emulsion having associated therewtih an image dye-providing material, b. an image-receiving layer and c. means containing an alkaline processing composition adapted to discharge its contents within said film unit, the improvement wherein said silver halide emulsion has associated therewith a blocked development restrainer of the formula:

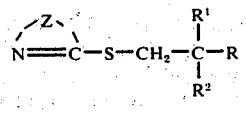

wherein Z represents the nonmetallic atoms necessary to form an uncharged nucleus which completes a 5- or 6-membered heterocyclic ring on said structure; R is a cyano group; and $R^1$ and $R^2$ can each be hydrogen atoms, alkyl groups or aryl groups, provided at least one of $R^1$ and $R^2$ is a hydrogen atom.

15. A film unit according to claim 14 wherein said image-receiving layer is located on a separate support and is adapted to be superposed on said photosensitive element during processing.

16. A film unit according to claim 14 wherein said silver halide emulsion is a negative silver halide emulsion.

17. A film unit according to claim 14 wherein said blocked development restrainer is located in said layer containing said silver halide emulsion.

18. An image-transfer film unit adapted to be processed by passing said unit between a pair of juxtaposed pressure-applying members comprising:

a. a photosensitive element comprising a support having thereon a layer containing a silver halide emulsion having associated therewith an image dye-providing material, b. an image-receiving layer, c. a cover sheet superposed or adapted to be superposed on said photosensitive element and d. a means for discharging an alkaline processing composition within said film unit, wherein at least one layer between said support and said cover sheet of said film unit contains a blocked development restrainer having the formula:

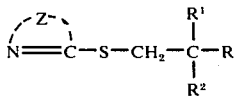

wherein Z represents the nonmetallic atoms necessary to form a nucleus which completes a 5- or 6-membered heterocyclic ring on said structure; R is a cyano group; and $R^1$ and $R^2$ can each be hydrogen atoms, alkyl groups or aryl groups, provided at least one of $R^1$ and $R^2$ is a hydrogen atom.

19. A film unit according to claim 18 wherein said image-receiving layer is located on said cover sheet.

20. A film unit according to claim 18 wherein said support of said photosensitive element is a transparent support which has thereon said image-receiving layer, an opaque layer, a layer containing a red-sensitive silver halide emulsion, a layer containing a green-sensitive silver halide emulsion and a layer containing a blue-sensitive silver halide emulsion, at least one of said layers containing silver halide emulsion having associated therewith an image dye-providing material.

21. A film unit according to clam 20 wherein each of said layers containing silver halide emulsions has associated therewith an image dye-providing material.

22. A film unit according to claim 18 wherein said layer containing said silver halide emulsion has associated therewith at least 0.005 mole of said blocked development restrainer per mole of silver.

23. A film unit according to claim 18 wherein said blocked development restrainer is a compound having the formula:

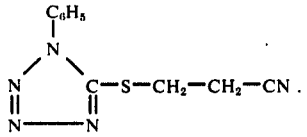

24. A film unit according to claim 18 wherein said silver halide emulsion is a negative silver halide emulsion.

25. A film unit according to claim 23 wherein the cover sheet remains laminated with the photosensitive element after processing.

26. A film unit according to claim 18 wherein said image dye-providing material is an oxichromic developer.

27. In a process for producing a photographic transfer image comprising:

a. imagewise-exposing a photosensitive element comprising a support having thereon a layer containing a silver halide composition having associated therewith an image dye-providing material, b. treating said photosensitive element with an alkaline processing composition to effect development of said exposed silver halide emulsion layer, c. forming an imagewise distribution of diffusible image dye-providing material as a function of development of said silver halide emulsion layer, and d. at least a portion of said imagewise distribution of diffusible image dye-providing material diffusing to an image-receiving layer, the improvement wherein said silver halide emulsion has associated therewith a blocked development restrainer of the formula:

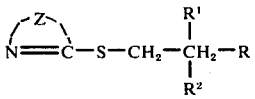

wherein Z represents the nonmetallic atoms necessary to form an uncharged nucleus which completes a 5- or 6-membered heterocyclic ring on said structure; R is a cyano group; and $R^1$ and $R^2$ can each be hydrogen atoms, alkyl groups or aryl groups.

28. A process according to claim 27 wherein said photosensitive element contains a layer containing a red-sensitive negative silver halide emulsion, a layer containing a green-sensitive negative silver halide emulsion and a layer containing a blue-sensitive negative silver halide emulsion, at least one of said layers containing silver halide emulsion having associated therewith an image dye-providing material.

29. A process according to claim 28 wherein each of said layers containing silver halide emulsions has associated therewith an initially diffusible image dye-providing material.

30. A process according to claim 28 wherein each of said layers containing silver halide emulsions has associated therewith an initially immobile, image dye-providing material.

31. A process according to claim 27 wherein said photosensitive element is treated with an alkaline processing composition having a pH of at least 12.

32. A process according to claim 27 wherein said image dye-providing material is a positive-working, immobile, image dye-providing material.

33. A process according to claim 27 wherein said image dye-providing material is an oxichromic developer.

* * * * *

UNITED STATES PATENT AND TRADEMARK OFFICE

CERTIFICATE OF CORRECTION

PATENT NO. : 4,009,029

DATED : February 22, 1977

INVENTOR(S) : Hammond et al

It is certified that error appears in the above-identified patent and that said Letters Patent are hereby corrected as shown below:

Column 1, line 14, "photograhic" should read --photographic--. Column 2, line 10, "particulaly" should read --particularly--; line 11, "about" should read --above--. Column 3, lines 23-24, "herterocyclic" should read --heterocyclic--. Column 4, line 6, "medium," should read --medium;--. Column 5, end of line 13, "in" should read --an--; line 67, "tyie" should read --type--. Column 6, line 58, "liguid" should read --liquid--. Column 10, line 37, that part of formula reading "cyanuethylthio)" should read --cyanoethylthio)--; that part of formula reading "phenyltetrazale" should read --phenyltetrazole--. Column 11, line 29, that part of formula reading "disec" should read --di-sec--; line 37, that part of formula reading "disec" should read --di-sec--; line 46, that part of formula reading "disec" should read --di-sec--. Column 12, line 2, "4-metylphenyl" should read --4-methylphenyl--. Column 13, line 29, "photograhic" should read --photographic--; lines 46-47, "2-cyanoethylthio)-lauramide" should read --diethyl lauramide--; line 47, that part of formula reading "(2:cyanoethylthio)" should read --(2-cyanoethylthio)--; line 51, "mg./ft.$^2$ 2,5-" should read --mg./ft.$^2$, 2,5- --; line 52, "magneta" should read --magenta--; line 60, that part of formula reading "tetrahydro5,8" should read --tetrahydro-5,8---; line 64, "diethl" should read --diethyl--; lines 66-67, "bromoidiode" should read --bromoiodide--. Column 15, line 63, that part of formula reading "secdodecylhydroquinone" should read --sec-dodecylhydroquinone--.

UNITED STATES PATENT AND TRADEMARK OFFICE

CERTIFICATE OF CORRECTION

PATENT NO. : 4,009,029

DATED : February 22, 1977

INVENTOR(S) : Hammond et al

It is certified that error appears in the above-identified patent and that said Letters Patent are hereby corrected as shown below:

Column 16, line 62, "various" should read --viscous--. Column 17, approximate line 27, "Dye Releaser I" should be placed further up the column with the compound structure to which it pertains. Column 18, line 4, "nd" should read --and--; line 65, that part of formula reading "secdodecylhydroquinone" should read --sec-dodecylhydroquinone--. Column 20, lines 55-end, that part of formula set forth as:

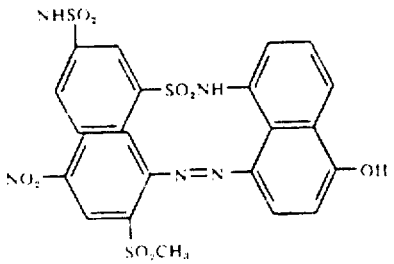

should read

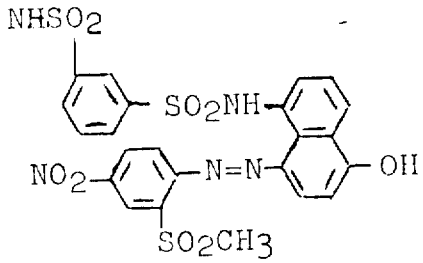

Column 23, line 41, "grup;" should read --group;--. Column 24, line 16, "aid" should read --said--; line 25, "aid" should read --said--; line 50, "therewtih" should read --therewith--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*